United States Patent [19]

Schütz

[11] Patent Number: 4,531,922

[45] Date of Patent: Jul. 30, 1985

[54] SAILBOARD AND PROCESS FOR ITS PRODUCTION

[76] Inventor: Udo Schütz, Bahnhofstrasse 25, D-5418 Selters, Fed. Rep. of Germany

[21] Appl. No.: 562,017

[22] Filed: Dec. 16, 1983

[30] Foreign Application Priority Data

Dec. 16, 1982 [DE] Fed. Rep. of Germany ..... 3246578

[51] Int. Cl.[3] ..... B63B 5/24

[52] U.S. Cl. ..... 441/74; 114/357; 114/39

[58] Field of Search ..... 114/39.2, 357, 355; 156/245, 242, 304.2, 330, 285; 441/74; 264/46.5, 46.6, 46.8, 46.9; 244/123

[56] References Cited

U.S. PATENT DOCUMENTS

| | | | |
|---|---|---|---|
| 3,929,549 | 12/1975 | Smith | 114/357 X |
| 4,065,337 | 12/1977 | Alter et al. | 264/46.6 X |
| 4,120,632 | 10/1978 | Stoeberl | 264/46.8 X |
| 4,383,955 | 5/1983 | Rubio et al. | 264/46.6 |

*Primary Examiner*—Trygve M. Blix
*Assistant Examiner*—Edwin L. Swinehart
*Attorney, Agent, or Firm*—Young & Thompson

[57] ABSTRACT

In a sailboard made of a synthetic resin with an outer skin and a foam core, as well as with a stringer forming a longitudinal center wall, the outer skin (2) consists of a thermoplastic synthetic resin and of an upper and a lower half shell (3 and 4, respectively), formed by vacuum deep drawing. The half shells (3, 4) are continuously welded together along the equatorial line (8). The stringer (5) is integrally molded in double-wall fashion to the upper one and/or the lower one of the half shells (3, 4) with a profile that is U-shaped over at least the largest part of its length, and is welded, along the base of its U-shaped profile, to the respectively opposed half shell (3 or 4). The profile cavity of the stringer (5) is filled with glued-in-place hard foam elements (12) and sealed by profiled strips (14). The foam core (11) consists of a foam composition injected into the cavity defined by the welded-together half shells (3, 4).

5 Claims, 9 Drawing Figures

SAILBOARD AND PROCESS FOR ITS PRODUCTION

Figure 1:
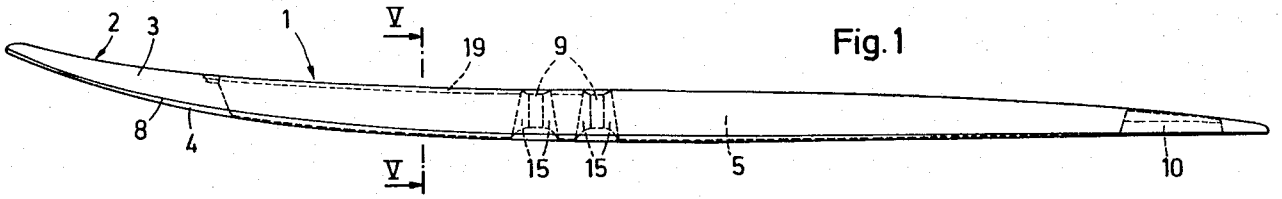

The invention relates to the production of sailboards of a synthetic resin with an outer skin and a foam core, as well as with a stringer forming a longitudinal center wall.

Such a sailboard is known, for example, from U.S. Pat. No. 3,929,549. This sailboard consists of two lateral halves with respectively one outer skin of glass-fiber-reinforced synthetic resin and respectively one foam core. The halves are joined together by way of a thick layer of epoxy resin, forming a longitudinal support (stringer) having approximately the shape of a double "T" and having the purpose of increasing the flexural strength of the sailboard. The solid longitudinal support or stringer increases the weight of the sailboard considerably and thus reduces its buyoancy on the water. Besides, the process for manufacturing this known sailboard is cumbersome and expensive.

The invention is based on the object of simplifying series production and providing at the same time, practically without an increase in weight, a stringer to raise the flexural strength of the sailboard.

This object has been attained by the characterizing features (a) through (e) in claim 1, as well as by the process steps outlined herein. Additional suitable embodiments of the invention can be derived from the dependent claims.

Figure 2:
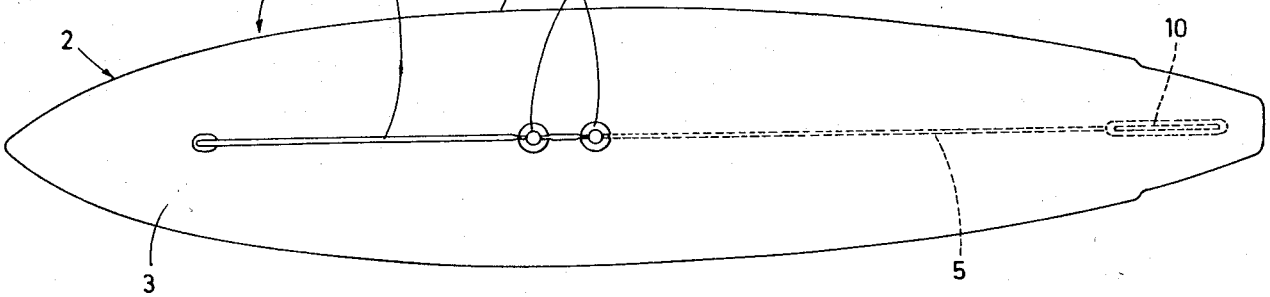
Figure 3:
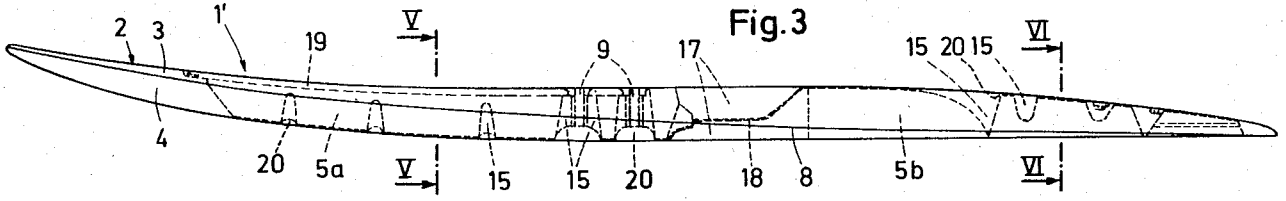
Figure 4:
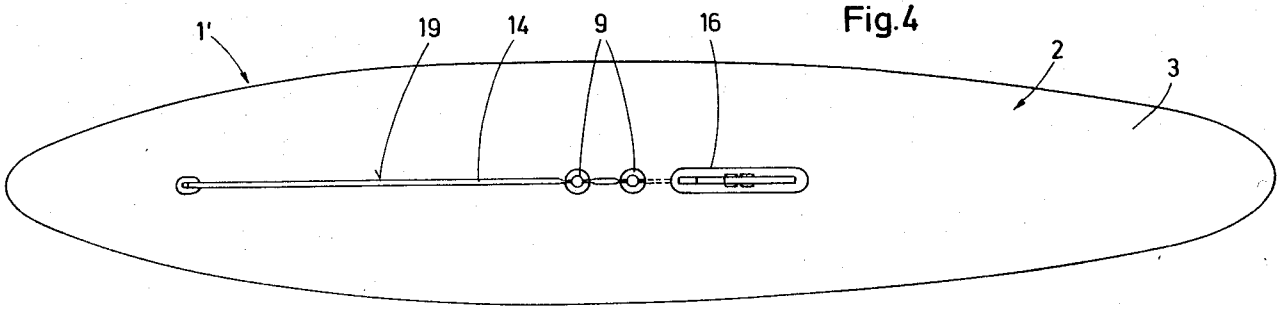
Figure 5:
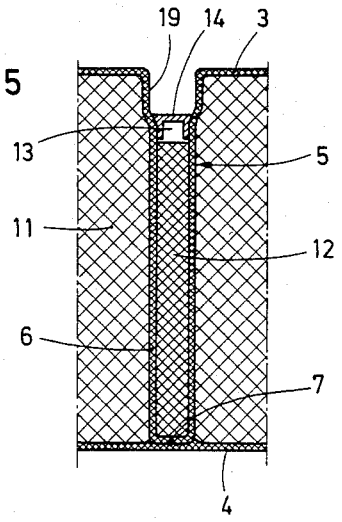
Figure 6:
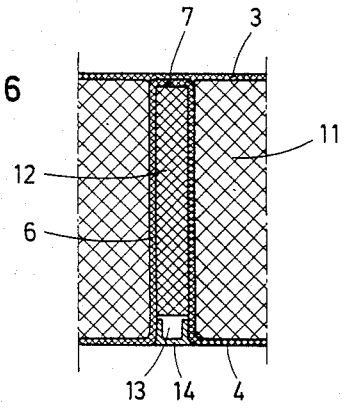
Figure 7:
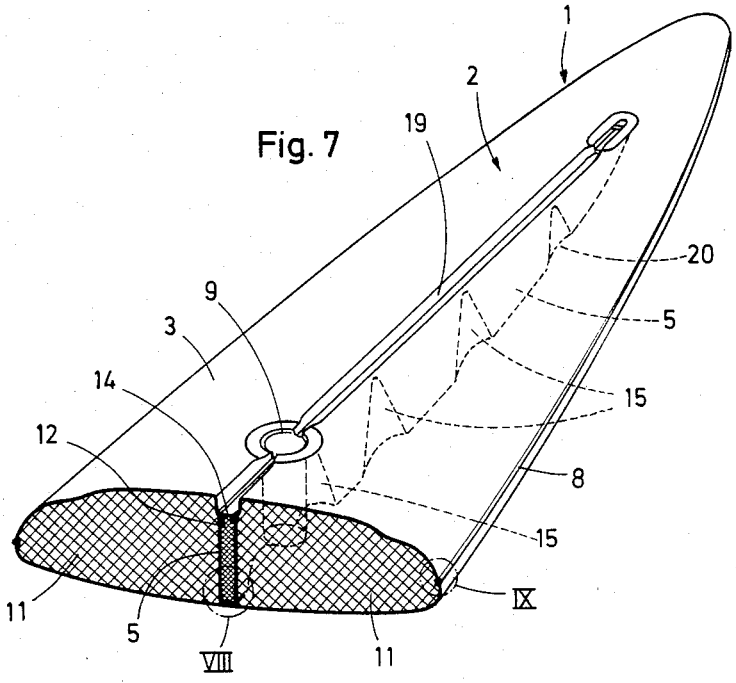
Figure 8:
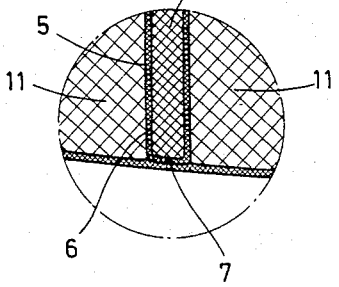
Figure 9:
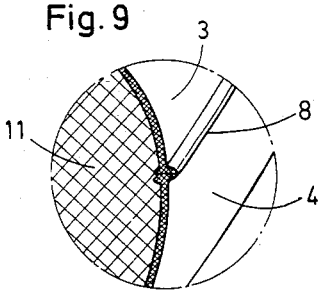

Examples of the invention are illustrated in the drawings wherein:

FIG. 1 shows, in a lateral view, a first embodiment of a sailboard according to the invention, FIG. 2 shows a top view of this sailboard, FIG. 3 shows, in a lateral view, a second embodiment with a possibility for using a centerboard, FIG. 4 shows a top view of this sailboard, FIG. 5 shows a section along line V—V in FIGS. 1 and 3, FIG. 6 shows a section along line VI—VI in FIG. 3, FIG. 7 shows a perspective view of a bow section of a sailboard, FIG. 8 shows an enlarged fragmentary view VIII from FIG. 7, and FIG. 9 shows an enlarged fragmentary view IX from FIG. 7.

In the sailboard 1 illustrated in FIGS. 1 and 2, the outer skin 2 consists of an upper half shell 3 and a lower half shell 4, molded by the vacuum deep drawing method from a thermoplastic synthetic resin and welded together during that step while still in the plastic condition. During the vacuum deep drawing operation, a stringer 5 is molded to the upper half shell 3 in this example; this stringer exhibits an upwardly open U profile 6 (see FIG. 5) with a base 7 welded to the lower half shell 4. Around the outside, the half shells 3, 4 are welded together along an equatorial line 8. During the vacuum deep drawing step, the double walls of the stringer 5 are molded around mast base bushings 9 connected with the deep drawing mold (not shown) in such a way that this mold, after the deep drawing and welding process, can be separated from the molding (upper half shell 3). The same procedure is followed for the insertion of a rudder well 10 which is connected, during vacuum deep drawing, with the deep drawing mold for the lower half shell 4. As illustrated by the sectional view of FIG. 5, the cavity defined by the outer skin 2 formed by the welded-together half shells 3, 4 is filled with a foam core 11; the foam material is injected after finishing production of the cavity of the sailboard 1 subsequently to gluing corresponding hard foam elements 12 in the open U-shaped profile 6 of the stringer 5 and sealing the slot-like opening 13 of the U-shaped profile 6 by glued-in-place profiled strips 14 (see FIGS. 5 and 6). Around the mast base bushings 9, the two walls of the U profile 6 of the stringer 5 are directly welded together at 15.

A second example for a sailboard 1 is shown in FIGS. 3 and 4. This is a design wherein there is the possibility of inserting a centerboard (not shown) in a centerboard well 16 (FIG. 4). Identical reference numerals are employed in FIGS. 3 and 4 for elements that are the same or similar as those in FIGS. 1 and 2. In this embodiment, the stringer 5 is subdivided into a forward stringer section **5*a* open in the upward direction, and a rearward stringer section 5*b* open in the downward direction. Both stringer sections 5*a*, 5*b* are welded together in a common transverse wall 18 in the zone of a centerboard recess 17 and are welded along their bases 7 to the respectively adjoining upper and lower half shells 3 and 4, respectively. The transverse wall 18 is cut out before the centerboard well 16 is inserted, for example cemented in place. The upwardly open, forward stringer section 5*a* is sealed, after gluing the hard foam elements in place, by the profiled strip 14 which is arranged in a hidden fashion so that a groove 19 is formed for insertion of a rigging tether line (not shown). Knots or sleeves can be provided on the rigging safety line with which it can be clamped into the groove 19. The hidden profiled strip 14 and the groove 19 can clearly be seen in FIG. 5. Also the stringer section 5*a*, 5*b* exhibit locations 15 where the walls of the U profile 6 are welded together in the way of a webbing. This results in an improved total stability of the stringer 5**.

Even though the preceding description contains the manufacturing method in rough outline, FIG. 7 will be used to once more demonstrate the individual process steps, presupposing a vacuum deep drawing device comprising an upper mold part and a lower mold part corresponding to half shells 3, 4, furthermore two clamping frames to receive the planar slices of thermoplastic synthetic resin, and a reciprocating heating unit to heat the synthetic resin slices into the plastic condition. Besides, the two mold parts, with a corresponding concomitant movement of the clamp frames, must be movable toward each other and, of course, must be capable of connection to a vacuum source.

First of all, the planar synthetic resin slabs are clamped into the clamp frames so that they are retained all around, outside of the contours of the equatorial line 8. Then the heating device is introduced in between the two synthetic resin slabs to heat same. Once the slabs have reached the plastic condition, the heating device is moved out, the mold parts of the vacuum deep drawing device are moved toward each other, for example the upper mold part is lowered onto the lower mold part, the two clamp frames being moved so that they are, at the end of all motion processes, approximately at the level of the equatorial line 8 of the thus-formed hollow member. By pressing the molded parts together, the upper and lower half shells 3, 4 are heat-sealed along the equatorial line 8 as well as along the bases 7 of the U-shaped profile 6 of the stringer 5 or **5*a*, 5*b*, and, in the embodiment of FIG. 3, also along the transverse wall 18 of the centerboard recess 17**.

Thereafter the cavity of the U-shaped profile 6 of the stringer 5 or 5*a*, 5*b* is filled with the hard foam elements 12 which are glued in place, and the slot-like opening 13 of the stringer 5 is sealed by gluing the profiled strips 14 in place. In a supporting mold, similar to the mold parts of the vacuum deep drawing device, without the centerboard-like insertions for forming the stringer 5, the foam components for the foam core 11 are injected by way of appropriate bores in the outer skin 2. At the locations 15 of the web-like constrictions of the stringer walls, transverse openings 20 are produced since here the base 7 is missing; the foam material for the foam core 11 can converge from both sides of the stringer 5 by flowing through these transverse openings. It is understood that the weld seam along the equatorial line 8 is machined to avoid sharp edges, and that the injection bores for the foam core 11 are subsequently sealed with appropriate plugs (not shown) by gluing or are closed by welding.

What is claimed is:

1. Sailboard made of a synthetic resin with an outer skin and with a foam core, as well as with a stringer forming a longitudinal center wall, characterized by the following features:

(a) the outer skin (2) of a thermoplastic synthetic resin consists of an upper half shell and a lower half shell (3 and 4, respectively), formed by vacuum deep drawing;

(b) the half shells (3, 4) are welded together all around the equatorial line (8);

(c) the stringer (5) is integrally molded in doublewall fashion to the upper and/or lower one of the half shells (3, 4) with a profile (6) that is U-shaped over at least the largest portion of its length, and is welded, at the base (7) of its U profile (6), to the respectively opposed half shell (3 or 4);

(d) the profile cavity or profile cavities of the stringer (5; 5*a*, 5*b*) is or are filled with glued-in-place hard foam elements (12) and sealed by profiled strips (14);

(e) the foam core (11) consists of a foam material injected into the cavity defined by the welded-together half shells (3, 4).

2. Sailboard according to claim 1, characterized by insertion or pass-through elements (9, 10) for sailboard acessory mountings, surrounded by the stringer (5) in a shape-mating fashion during the vacuum deep drawing process.

3. Sailboard according to claim 1, characterized in that the profile cavities of the stringer (5; 5*a*, 5*b*) are interrupted at longitudinal spacings by webbing-like welded-together portions (15) of the two stringer walls.

4. Sailboard according to claim 1 with a centerboard well for the insertion of a centerboard, characterized in that the base (7) of the stringer (5*a*) is welded, from the bow to the centerboard recess (17), to the lower half shell (4) and, from there up to the stern, to the upper half shell (3); and that the upper and lower half shells (3, 4) are welded together in the zone of the centerboard recess (17) to a transverse wall (18) that can be cut out for insertion of the centerboard well (16).

5. Sailboard according to claim 1, characterized in that the profiled strip (14) sealing the profile cavity of the stringer (5, 5*a*) is arranged to be hidden from the bow-side end of the stringer (5) up to one or several mast base bushings (9), in order to form a receiving groove (19) for a rigging safety line.

* * * * *